US006690904B2

(12) United States Patent
Wang et al.

(10) Patent No.: US 6,690,904 B2
(45) Date of Patent: Feb. 10, 2004

(54) DEVELOPER CONTAINER

(75) Inventors: Jui-Chi Wang, Wu-Chi (TW); Robin Hsu, Wu-Chi (TW); Ya Li Huang, Wu-Chi (TW); Mei Hsia Chang, Wu-Chi (TW)

(73) Assignee: General Plastics Industrial Co., Ltd. (TW)

( * ) Notice: Subject to any disclaimer, the term of this patent is extended or adjusted under 35 U.S.C. 154(b) by 0 days.

(21) Appl. No.: 09/949,228

(22) Filed: Sep. 7, 2001

(65) Prior Publication Data

US 2003/0049052 A1 Mar. 13, 2003

(30) Foreign Application Priority Data

Jul. 6, 2001 (TW) ..... 90211542 U

(51) Int. Cl.[7] ..... G03G 15/08
(52) U.S. Cl. ..... 399/262
(58) Field of Search ..... 399/262, 260, 399/258

(56) References Cited

U.S. PATENT DOCUMENTS 5,907,756 A * 5/1999 Shirota et al. ..... 399/262

FOREIGN PATENT DOCUMENTS

| | | |
|---|---|---|
| JP | 4-134472 | * 5/1992 |
| JP | 7-261550 | * 10/1995 |
| JP | 8-171330 | * 7/1996 |
| JP | 11-327277 | * 11/1999 |

* cited by examiner

*Primary Examiner*—Quana M. Grainger
(74) *Attorney, Agent, or Firm*—Merchant & Gould, LLC

(57) ABSTRACT

A developer container in which the container body has an inwardly protruded spiral guide flange spirally extending from the rear close side to a developer supply port of the container body and defining a spiral flow guide way adapted to guide developer from the inside of the container body to the outside of the container body through the developer supply port, wherein the developer supply port having a recessed developer accumulation area and a through hole through the center of the recessed developer accumulation area, the spiral guide flange has a beveled guide face extending to the recessed developer accumulation area.

5 Claims, 4 Drawing Sheets

DEVELOPER CONTAINER

BACKGROUND OF THE INVENTION

The present invention relates to a developer container for use in a copy machine or the like and, more particularly to such a developer container, which prevents the formation of laminar flow when rotated to supply developer.

FIG. 1 shows a developer container constructed according to U.S. Pat. No. 5,528,349. The container body A of this structure of the developer container comprises a developer supply hole C disposed near the front side thereof, and a spiral guide flange B adapted to guide developer toward the developer supply hole C. The spiral guide flange B has a front straight portion B1 spaced from the developer supply hole C by a space A1. This structure of the developer container is still not satisfactory in function. When developer is being depleted, a certain amount of developer residue is left in the space A1 and cannot be expelled out of the container body A. The developer residue will cause environmental pollution when the used developer container is discarded. Further, continuous rotation of the container body A to move the developer out of the developer supply hole C may cause a laminar flow, resulting in a bridging effect and condensing of the developer.

SUMMARY OF THE INVENTION

The present invention has been accomplished to provide a developer container, which eliminates the aforesaid drawbacks. In one aspect, the present invention relates to a developer container, which prevents the formation of developer residue. In another aspect, the present invention relates to a developer container, which prevents the formation of laminar flow and prevents the developer from condensing. According to the present invention, the container body of the developer container comprises a plurality of flat flow guide portions, a plurality of oblique flow guide portions alternatively spirally connected in series, and an inwardly protruded spiral guide flange spirally extended from the rear close side of the container body to the developer supply port near the front developer filling opening of the container body, wherein the inwardly protruded spiral guide flange, the flat flow guide portions, and the oblique flow guide portions define a spiral flow guide way adapted to guide developer from the inside of the container body to the outside of the container body through the developer supply port. The developer supply port has a recessed developer accumulation area and a through hole through the center of the recessed developer accumulation area. The spiral guide flange has a beveled guide face extended to the recessed developer accumulation area.

DETAILED DESCRIPTION OF THE PREFERRED EMBODIMENT

Figure 1:
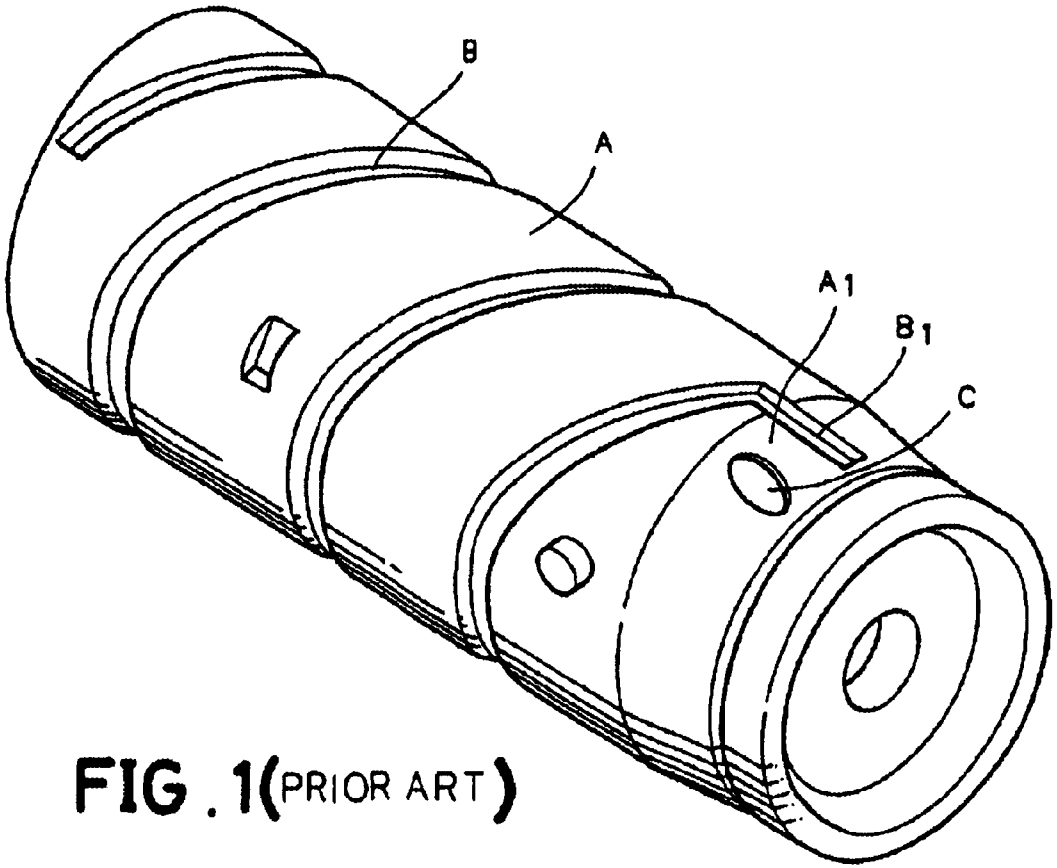
FIG. 1(PRIOR ART)
FIG. 1 is an elevational view of a developer container according to U.S. Pat. No. 5,528,349.
Figure 2:
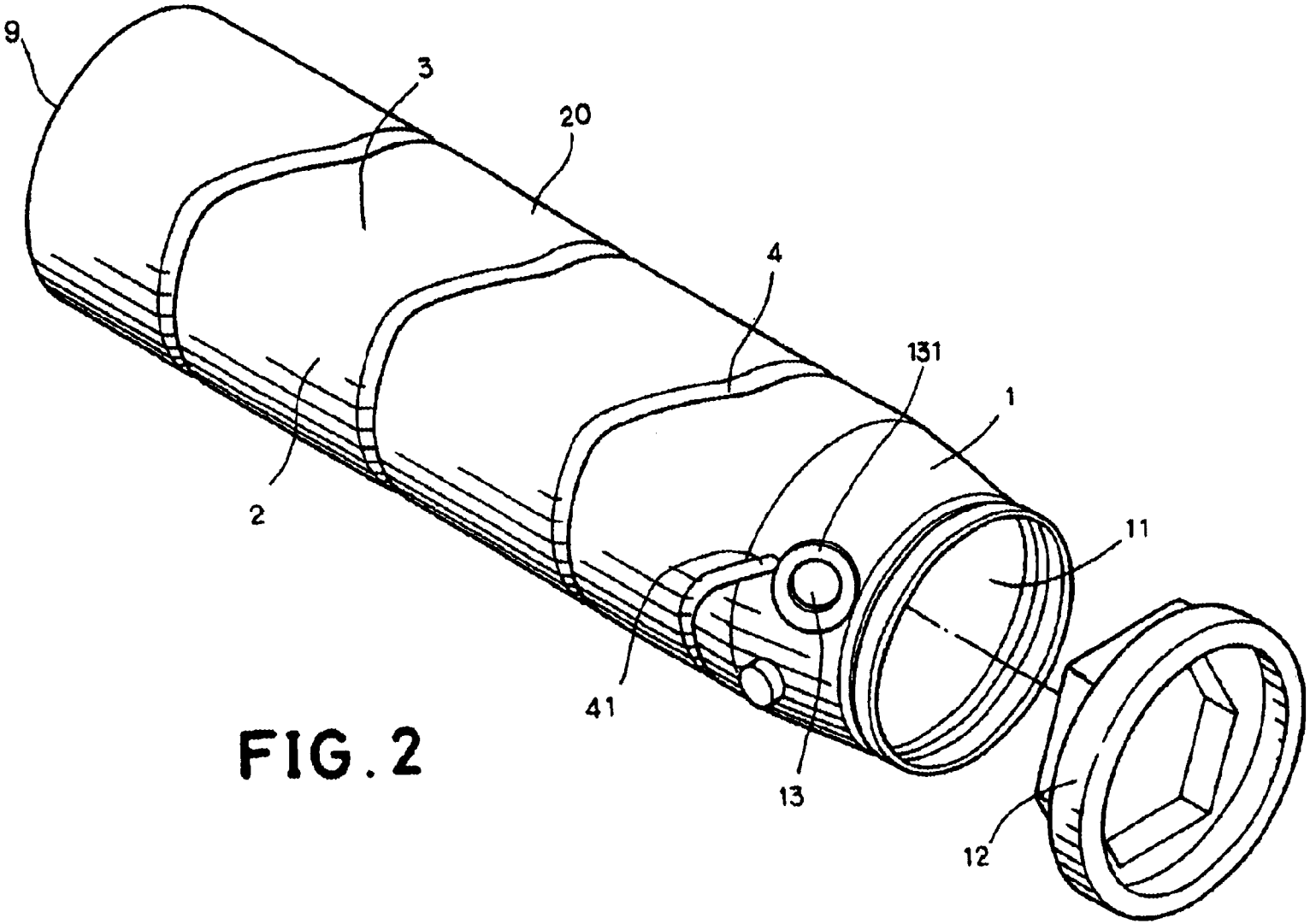
FIG. 2 is an exploded view of a developer container according to the present invention.
Figures 3, 3A:
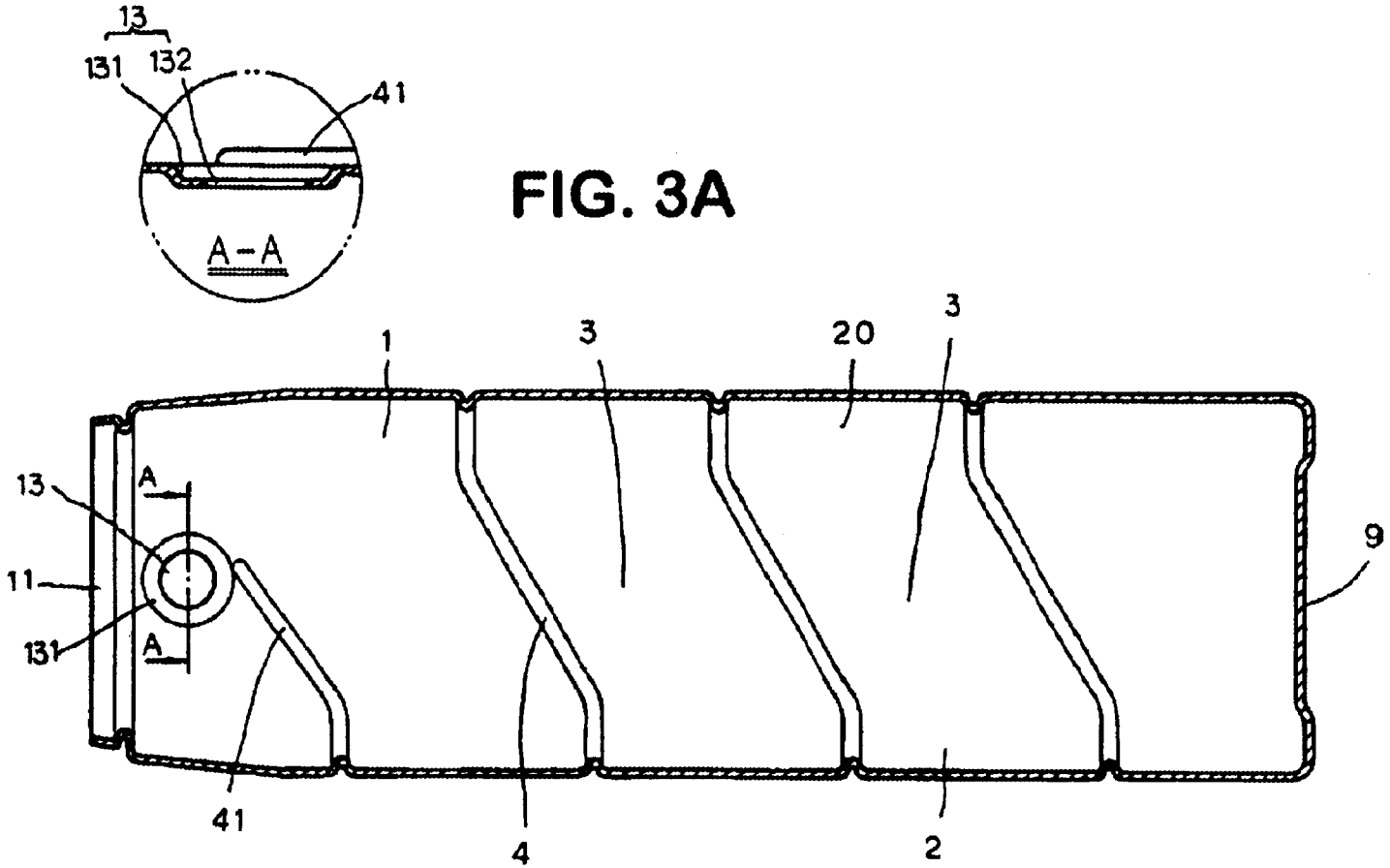
FIG. 3 is a longitudinal sectional view of the developer container according to the present invention.
FIG. 3A is an enlarged view taken along line A—A of FIG. 3.

Referring to FIGS. 2 and 3, a developer container is shown comprising a cylindrical container body 1, and a cap 12. The cylindrical container body 1 has a front opening 11 through which developer is filled into the inside of the container body 1. The cap 12 is adapted to close the front opening 11.

The container body 1 comprises a developer supply port 13 adjacent to the front opening 11, a plurality of flat flow guide portions 2 and 20 alternatively arranged substantially perpendicular to the longitudinal axis of the container body 1 at two opposite lateral sides of the container body 1, a plurality of oblique flow guide portions 3 connected between the flat flow guide portions 2 and 20, and an inwardly protruded spiral guide flange 4 spirally extended from the rear close side 9 of the container body 1 to the developer supply port 13, wherein the inwardly protruded spiral guide flange 4, the flat flow guide portions 2 and 20, and the oblique flow guide portions 3 define a spiral flow guide way adapted to guide developer from the inside of the container body 1 to the outside of the container body 1 through the developer supply port 13. The developer supply port 13 comprises a recessed developer accumulation area 131 and a through hole 132 through the center of the recessed developer accumulation area 131. The spiral guide flange 4 has a beveled guide face 41 extended to the recessed developer accumulation area 131.

When rotating the container body 1, developer is forced by the spiral guide flange 4 to move forwards from one oblique flow guide portion 3 to one flat flow guide portion 2, and then from the flat flow guide portion 2 to the anterior flat flow guide portion 20. Continuously rotating the container body 1 causes the developer to move smoothly in the spiral flow guide way along the spiral guide flange 4 toward the developer supply port 13. When moving the front side of the container body 1, the flow of developer is stopped by the spiral guide flange 4 from passing to the front opening 11 and is guided by the beveled guide face 41 of the spiral guide flange 4 to the recessed developer accumulation area 131 and then to the outside of the container body 1 through the through hole 132 for use by the copy machine.

Figure 4:
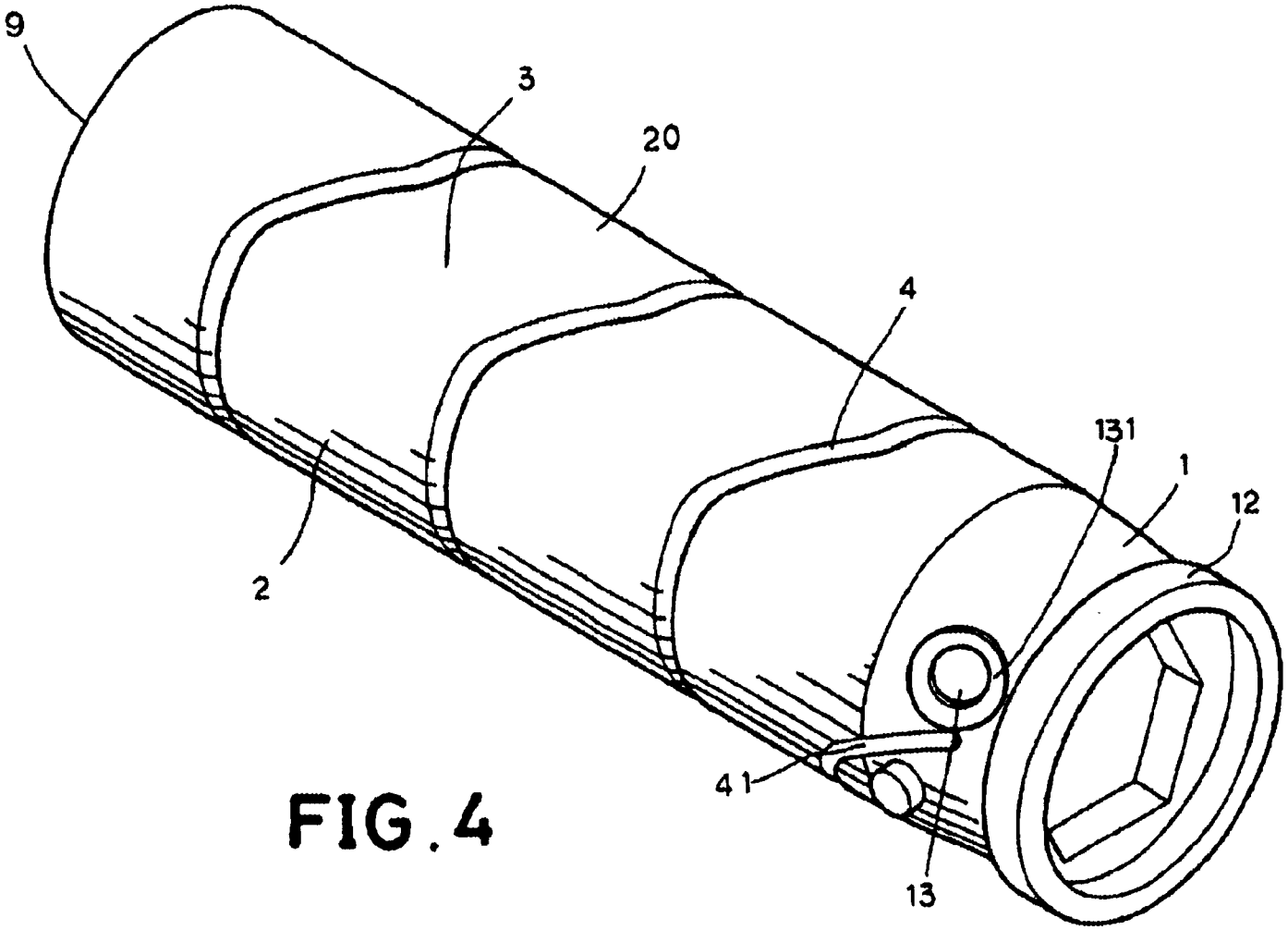
FIG. 4 illustrates an alternate form of the container body according to the present invention.

FIG. 4 shows an alternate form of the present invention. According to this alternate form, the beveled guide face 41 of the spiral guide flange 4 extends to one side of the developer supply port 13 adjacent to the front opening 11.

A prototype of developer container has been constructed with the features of FIGS. 2~4. The developer container functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A developer container comprising a container body, said container body comprising:

a rear close end;

an opposite front end defining a front developer filling opening;

a developer supply port adjacent to said front developer filling opening;

a plurality of flat flow guide portions alternatively arranged substantially perpendicular to a longitudinal axis of said container body at two opposite lateral sides of said container body;

a plurality of oblique flow guide portions connected between corresponding said flat flow guide portions to form a spiral flow guide way adapted to guide developer from the inside of said container body to the outside of said container body through said developer supply port; and an inwardly protruded spiral guide flange spirally extended from the rear close side of said container body to said developer supply port, wherein said inwardly protruded spiral guide flange, said flat flow guide portions, and said oblique flow guide portions define the spiral flow guide way adapted to guide developer from the inside of said container body to the outside of said container body through said developer supply port, and wherein said inwardly protruded spiral guide flange comprises a beveled guide face extended to a recessed developer accumulation area of said developer supply port.

2. The developer container as claimed in claim 1, further comprising a cap adapted to close the front developer filling opening of said container body.

3. The developer container as claimed in claim 1, wherein said developer supply port comprises a recessed developer accumulation area, and a through hole through the center of said recessed developer accumulation area.

4. The developer container as claimed in claim 3, wherein said beveled guide face of said spiral guide flange is tangent to an upper side of said recessed developer accumulation area of said developer supply port.

5. The developer container as claimed in claim 3, wherein said beveled guide face of said spiral guide flange is tangent to a lower side of said recessed developer accumulation area of said developer supply port.

* * * * *